US007404386B1

(12) United States Patent
Raghavan et al.

(10) Patent No.: US 7,404,386 B1
(45) Date of Patent: Jul. 29, 2008

(54) MULTI-STEP VALVE ACTUATION SYSTEM

(75) Inventors: Madhusudan Raghavan, West Bloomfield, MI (US); Burak A. Gecim, Rochester Hills, MI (US); John Ioan Manole, Chesterfield, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/674,166

(22) Filed: Feb. 13, 2007

(51) Int. Cl.
*F01L 1/18* (2006.01)

(52) U.S. Cl. ..... 123/90.39; 123/90.44; 123/90.45; 123/90.48; 74/559; 74/569

(58) Field of Classification Search ..... 123/90.39, 123/90.41, 90.44, 90.48, 90.52, 90.55, 90.45; 74/559, 567, 569
See application file for complete search history.

(56) References Cited

U.S. PATENT DOCUMENTS 4,459,946 A 7/1984 Burandt
4,970,997 A 11/1990 Inoue et al.
5,351,662 A * 10/1994 Dopson et al. ..... 123/90.16
5,373,818 A 12/1994 Unger
6,112,711 A 9/2000 Shimizu et al.

OTHER PUBLICATIONS

Diggs et al. Engine and Valvetrain with Dual Pushrod Lifters and Independent lash Adjustment, US Patent Application Publication, US 2007/0119397 A1, May 31, 2007.*
SAE Document#: 2001/01/0243, A Study of a Continuous Variable Event and Lift (Vel) System, Book#: PT-122, Mar. 2001.

* cited by examiner

*Primary Examiner*—Ching Chang

(57) ABSTRACT

A multi-step valve actuation system is provided to selectively open a poppet valve of an internal combustion engine having a camshaft rotatably supported by a cylinder block. The multi-step valve actuation system includes a rocker arm operable to selectively open the poppet valve and a pushrod operable to bias the rocker arm. A first follower arm is engageable with a first cam of the camshaft and operates to selectively bias the pushrod. A lash adjuster is disposed between the first follower arm and the pushrod. A second follower arm is engageable with a second cam of the camshaft and selectively latchable with respect to the first follower arm, while a third follower arm is engageable with a third cam of the camshaft and selectively latchable with respect to the first follower arm. An internal combustion engine incorporating the multi-step valve actuation system of the present invention is also disclosed.

18 Claims, 2 Drawing Sheets

MULTI-STEP VALVE ACTUATION SYSTEM

TECHNICAL FIELD

The present invention relates to a multi-step valve actuation system for an internal combustion engine having an overhead valve, camshaft-in-block configuration.

BACKGROUND OF THE INVENTION

Recent advances in internal combustion engine operating strategies have led to the development of two-step or multi-step valve actuation systems. These systems allow two or more distinct valve lift profiles, thereby allowing a poppet valve of the internal combustion engine to be opened in accordance with one valve lift profile having a first predetermined maximum lift, when operating in one engine speed and load condition and to be opened in accordance with another valve lift profile having a second predetermined maximum lift, when operating in another engine speed and load condition. This two-step characteristic is usually facilitated in overhead camshaft internal combustion engines through the use of a switchable follower disposed between the camshaft, which is rotatably mounted with respect to a cylinder head, and the poppet valve. The increased amount of space required for the packaging of the multi-step valve actuation system has prevented its use within overhead valve, camshaft-in-block internal combustion engines where space is typically limited.

SUMMARY OF THE INVENTION

A multi-step valve actuation system is provided to selectively open a poppet valve of an internal combustion engine having a camshaft rotatably supported by a cylinder block. The multi-step valve actuation system includes a pivotably mounted rocker arm operable to selectively open the poppet valve and a pushrod operable to bias the rocker arm. A first follower arm is engageable with a first cam of the camshaft and operable to selectively bias the pushrod. Similarly, a second follower arm is engageable with a second cam of the camshaft and is selectively latchable with respect to the first follower arm for unitary movement. The first and second cam have respective first and second maximum valve lifts, such that the second maximum valve lift is greater in magnitude than the first maximum valve lift.

In operation, the poppet valve is opened to the first maximum valve lift when the second follower arm is unlatched from the first follower arm. Alternately, the poppet valve is opened to the second maximum valve lift when the second follower arm is latched to the first follower arm.

In one embodiment, a third follower arm is engageable with a third cam of the camshaft and is selectively latchable with respect to the first follower arm for unitary movement. Additionally, the third cam has a third maximum valve lift of greater magnitude than the first and second maximum valve lifts. In operation, the poppet valve is opened to the third maximum valve lift when the third follower arm is latched to the first follower arm.

A lash adjuster may be disposed between the first follower arm and the pushrod to account for clearances within the multi-step valve actuation system. The lash adjuster may be selectively collapsible to enable deactivation of the poppet valve. Each of the first, second, and third follower arms may rotatably support friction reducing roller assemblies. An internal combustion engine incorporating the multi-step valve actuation system is also disclosed.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
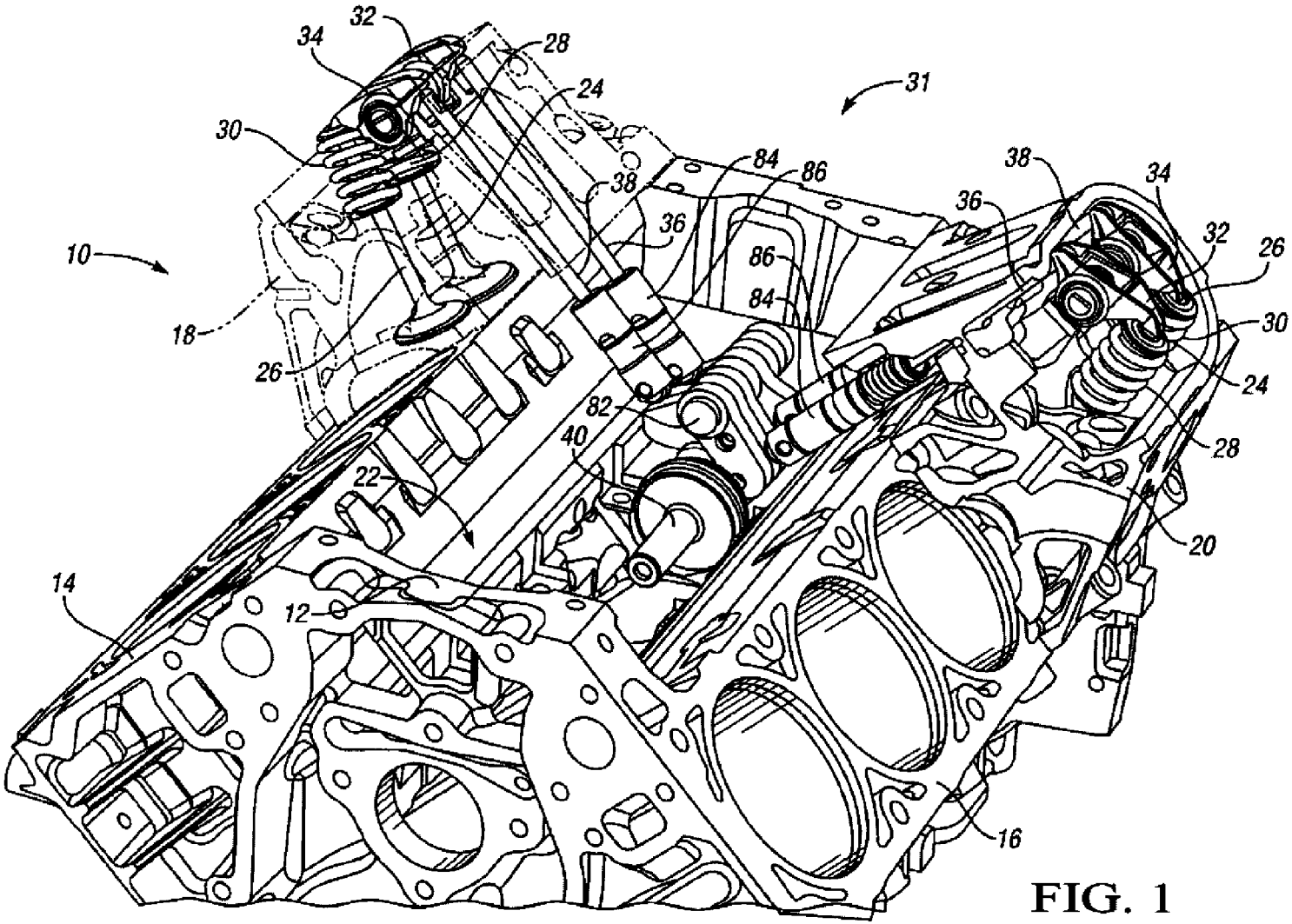
FIG. 1 is a perspective view of a portion of an internal combustion engine incorporating a multi-step valve actuation system of the present invention.

Referring to the drawings wherein like reference numbers correspond to like or similar components throughout the several figures, there is shown in FIG. 1 an internal combustion engine, generally indicated at 10. The internal combustion engine 10 includes a cylinder block 12 having a first bank of cylinders 14 and a second bank of cylinders 16. A first cylinder head 18, shown in phantom, and a second cylinder head 20 are mounted to a respective one of the first and second bank of cylinders 14 and 16. Only a portion of the first and second cylinder heads 18 and 20 are shown in FIG. 1. Those skilled in the art will realize that in a complete internal combustion engine 10, the first and second cylinder heads 18 and 20 will span substantially the entirety of the respective first and second cylinder banks 14 and 16. The first and second bank of cylinders 14 and 16 are arranged in a generally V-shaped configuration, thereby defining a valley 22. Therefore, the internal combustion engine 10 can be generally regarded as a V-type engine.

A selectively openable poppet valve 24 is at least partially contained within each of the first and second cylinder heads 18 and 20 and is operable to allow the selective introduction of intake air into the internal combustion engine 10. As such, the poppet valves 24 may be considered intake valves. Additionally, a selectively openable poppet valve 26 is at least partially contained within each of the first and second cylinder heads 18 and 20 and is operable to allow the selective exhaust of products of combustion from the internal combustion engine 10. As such, the poppet valves 26 may be considered exhaust valves. The poppet valves 24 and 26 are biased in a closed position by valve springs 28 and 30, respectively. With the arrangement of the poppet valves 24 and 26 discussed hereinabove, the internal combustion engine 10 may be characterized as an overhead valve engine.

The internal combustion engine includes a multi-step valve actuation system 31. The multi-step valve actuation system 31 includes rocker arms 32 and 34, pushrods 36 and 38, and camshaft 40. The camshaft 40 is rotatably supported within the cylinder block 12 by camshaft bearings 42, shown in FIG. 2; therefore, the internal combustion engine to may be further characterized as having a camshaft-in-block configuration. The rotation of the camshaft 40 forces or urges the pushrods 36 and 38 to bias the respective rocker arms 32 and 34 to effect the movement of the respective poppet valves 24 and 26 from the closed position to an open position. The rocker arms 32 and 34 are pivotably mounted with respect to the first and second cylinder heads 18 and 20. The construction and operation of the multi-step valve actuation system 31 will be discussed in greater detail with reference to FIG. 2. The hydraulic circuitry employed for the operation of the multi-step valve actuation system 31 has been removed from FIG. 1 for clarity.

Figure 2:
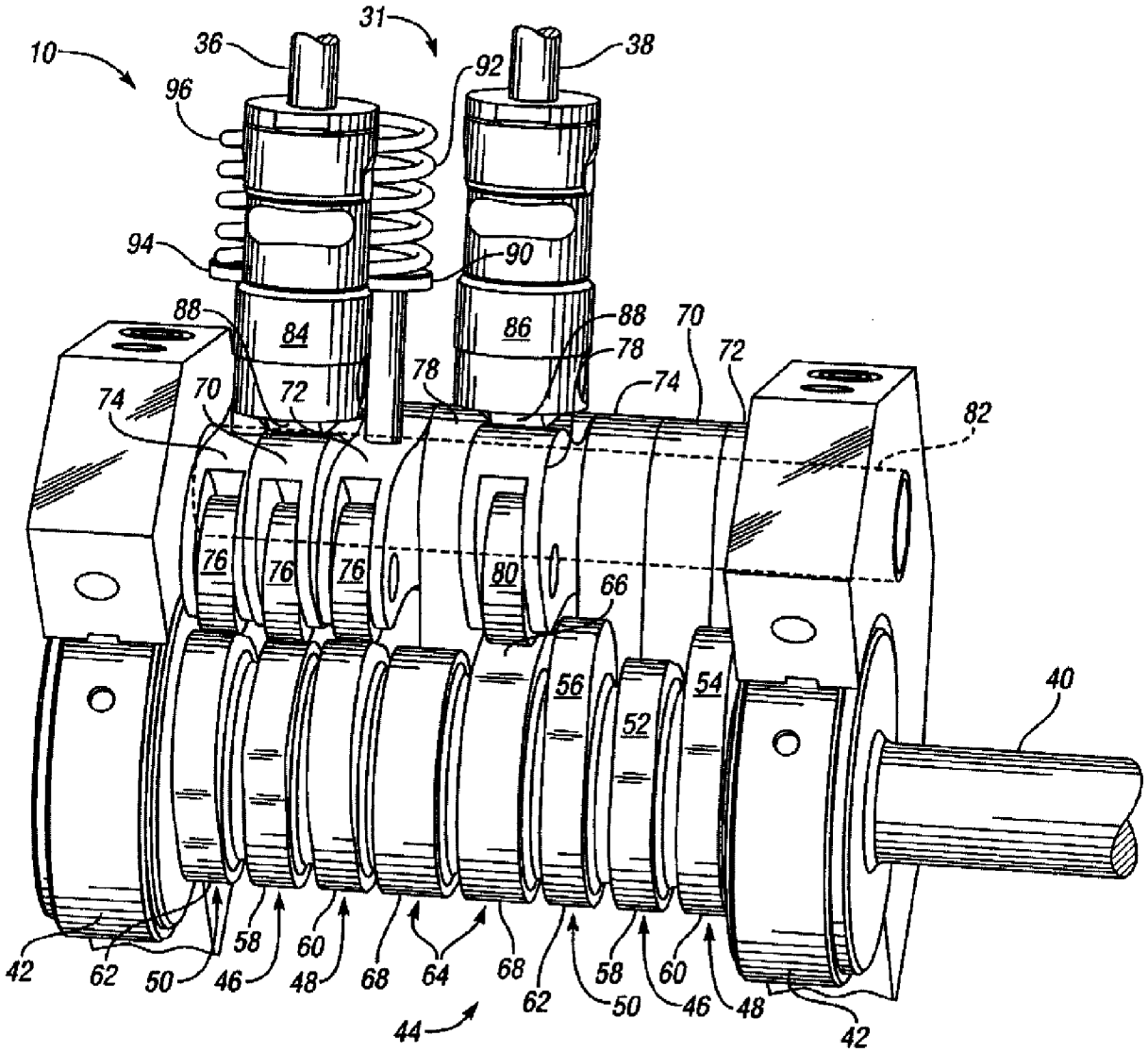
FIG. 2 is a perspective view of a portion of the multi-step valve actuation system of FIG. 1.

Referring to FIG. 2, and with continued reference to FIG. 1, there is shown a portion of the multi-step valve actuation system 31 of FIG. 1 further illustrating various aspects of the present invention. The camshaft 40 includes a plurality of cams 44 including first cams 46, second cams 48, and third cams 50 associated with the operation of the poppet valves 24, i.e. the intake valves, of the internal combustion engine 10. Each of the first, second, and third cams 46, 48, and 50 have a predetermined valve lift profile with a predetermined maximum valve lift determined by the respective first, second, and third lobe portions 52, 54, and 56. The first, second, and third cams 46, 48, and 50 further include respective first, second, and third base circle portions 58, 60, and 62. In the preferred embodiment, the predetermined maximum valve lift of the third cam 50 is greater than that of the second cam 48 which, in turn, has a greater predetermined maximum valve lift than that of the first cam 46.

Additionally, cams 64 are associated with the operation of the poppet valves 26, i.e. the exhaust valves, of the internal combustion engine 10. The cams 64 have a predetermined valve lift profile with a predetermined maximum valve lift determined by the lobe portion 66 of each of the cams 64, while a base circle portion 68 is also provided on each of the cams 64.

First, second, and third follower arms 70, 72, and 74 are engageable with the respective first, second, and third cams 46, 48, and 50. Each of the first, second, and third follower arms 70, 72, and 74 rotatably supports a roller assembly 76. The roller assemblies 76 operate to reduce the friction between the first, second, and third follower arms 70, 72, and 74 and the respective first, second, and third cams 46, 48, and 50 during rotation of the camshaft 40. Those skilled in the art will recognize that the roller assemblies 76 may be omitted, at the expense of greater frictional losses, while remaining within the scope of that which is claimed. The second and third follower arms 72 and 74 are each disposed on either side of the first follower arm 70 and are selectively latchable to the first follower arm 70 for unitary movement therewith. Those skilled in the art will recognize various methods of latching the second and third follower arms 72 and 74 with respect to the first follower arm 70, including, for example, a hydraulically actuated pin or a mechanically actuated pin. The latching of the second and third follower arms 72 and 74 to the first follower arm 70 is preferably performed when the first, second, and third follower arm 70, 72, and 74 are in contact with the base circle portions 58, 60, and 62 of the respective first, second, and third cams 46, 48, and 50.

Follower arms 78 are engageable with the cams 64 and include roller assemblies 80, one of which is shown in FIG. 2, which are operable to reduce friction between the follower arms 78 and the cams 64 as the camshaft 40 rotates. As with the roller assemblies 76, those skilled in the art will recognize that the roller assemblies 80 may be omitted, at the expense of greater frictional losses, while remaining within the scope of that which is claimed.

The follower arms 70, 72, 74, and 78 are pivotably mounted with respect to the cylinder block, shown in FIG. 1, by a shaft 82, shown with dashed lines in FIG. 2. The shaft 82 is spaced from the camshaft 40 and mounted substantially within the valley 22 of the internal combustion engine 10. By mounting the follower arms 70, 72, 74, and 78 within the valley 22 of the internal combustion engine 10, the multi-step valve actuation system 31 may be efficiently packaged within a space that would otherwise have been left empty in traditional camshaft-in-block engine designs. Additionally, by packaging the follower arms 70, 72, 74, and 78 within the valley 22, the design changes required to the first and second cylinder heads 18 and 20 to incorporate the multi-step valve actuation system 31 are minimized.

A hydraulic lash adjuster 84 is disposed between the first follower arm 70 and the pushrod 36. Similarly, a hydraulic lash adjuster 86 is disposed between the follower arm 78 and the pushrod 38. The hydraulic lash adjusters 84 and 86 are operable to account for the lash or clearance that may be present within the multi-step valve actuation system 31 during operation of the internal combustion engine 10. Preferably, each of the lash adjusters 84 and 86 each include a roller assembly 88 operable to reduce friction within the multi-step valve actuation system 31. Additionally, the lash adjusters 84 and 86 may be selectively collapsible to allow the respective poppet valves 24 and 26 to remain in the closed position irrespective of the rotation of the camshaft 40. This type of operation is especially suited for so-called Active Fuel Management or Displacement on Demand modes of engine operation where at least one of the cylinders of the internal combustion engine 10 is deactivated by maintaining the poppet valves 24 and 26 in the closed position. By maintaining the poppet valves 24 and 26 in the closed position, the pumping losses of the internal combustion engine 10 are decreased, thereby increasing operating efficiency. This mode of operation is beneficial during certain engine operating conditions, such as low load engine operation.

A plunger 90 is biased by a spring 92 to urge the second follower arm toward the second cam 48. Similarly, a plunger 94 is biased by a spring 96 to urge the third follower arm toward the third cam 50. The plungers 90 and 94 and springs 92 and 96 cooperate to keep the respective second and third follower arms 72 and 74 in contact with the respective second and third cams 48 and 50 during modes of engine operation when the second follower arm 72 and/or third follower arm 74 are unlatched from the first follower arm 70.

The multi-step valve actuation system 31 of the present invention provides three valve lift profiles to the poppet valve 24. In operation, the internal combustion engine 10 may operate in a low lift mode of operation where the poppet valve 24 is selectively opened in accordance with a predetermined valve lift profile having a predetermined maximum valve lift. This mode of operation is accomplished by unlatching the second and third follower arms 72 and 74 from the first follower arm 70 thereby allowing the first follower arm 70 to follow the profile of the first cam 46 and bias the pushrod 36 in accordance with the valve lift profile of the first cam 46. The plungers 90 and 94 and springs 92 and 96 cooperate to keep the respective second and third follower arms 72 and 74 in contact with the respective second and third cam 48 and 50. Those skilled in the art will recognize that the first cam 46 may be formed such that it provides zero lift to the poppet valve 24 thereby allowing the deactivation of the associated cylinder of the internal combustion engine 10.

When operating in the medium lift mode of operation, the second follower arm 72 is latched to the first follower arm 70 providing unitary movement therewith. The second follower arm 72 will follow the valve lift profile of the second cam 48 and cause the first follower arm 70 to bias the pushrod 36 in accordance with that profile. The first follower arm 70 no longer follows the profile of the first cam 46 in the medium lift mode of operation. The plunger 94 and spring 96 cooperate to keep the third follower arm 74 in contact with the third cam 50.

When operating in the high lift mode of operation, the third follower arm 74 is latched to the first follower arm 70 providing unitary movement therewith. The third follower arm 74 will follow the valve lift profile of the third cam 50 and cause the first follower arm 70 to bias the pushrod 36 in accordance with that profile. The first follower arm 70 no longer follows the profile of the first cam 46 and in the high lift mode of operation. The plunger 90 and spring 92 cooperate to keep the second follower arm 72 in contact with the second cam 48. Alternately, both the second and the third follower arm 72 and 74 may be latched to the first follower arm 70 during the high lift mode of operation.

Although the multiple lift functionality of the multi-step valve actuation system 31 has been described herein above with reference to the selective opening of the poppet valves 24, i.e. the intake valves, those skilled in the art will recognize that the multiple lift functionality may be applied to the poppet valves 26, i.e. the exhaust valves, should the operational strategies of the internal combustion engine 10 require such functionality. Additionally, a multi-step valve actuation system 31 having two lift functionality may be provided by eliminating the third follower arm 74 and the third cam 50. In the alternative, a multi-step valve actuation system 31 having greater than three distinct valve lifts may be provided by increasing the number of follower arms and respective cams.

The multi-step valve actuation system 31 may include a camshaft phaser, not shown, operable to adjust the timing of the camshaft 40, thereby providing a greater range of valve actuation functionality. The internal combustion engine 10 incorporating the multi-step valve actuation system 31 of the present invention is especially suited for use with an electrically variable hybrid transmission, or EVT, as the EVT may employ the variable valve lift and/or valve deactivation functionality provided by the multi-step valve actuation system 31 to optimize fuel economy. Further the multi-step valve actuation system 31 of the present invention may facilitate a Homogeneous Charge Compression Ignition, or HCCI, mode of operation for the internal combustion engine 10. When operating in the HCCI mode of operation, the intake valve may require multiple valve lift strategies and possible valve deactivation. Additionally, by providing the exhaust valve with valve reopening capabilities, such as is possible with a two lobe cam, selective re-breathing of products of combustion is possible thereby stabilizing the HCCI combustion process.

While the best modes for carrying out the invention have been described in detail, those familiar with the art to which this invention relates will recognize various alternative designs and embodiments for practicing the invention within the scope of the appended claims.

The invention claimed is:

1. A multi-step valve actuation system to selectively open a poppet valve of an internal combustion engine having a camshaft rotatably supported by a cylinder block, the multi-step valve actuation system comprising:

a rocker arm operable to selectively open the poppet valve;

a pushrod operable to bias said rocker arm;

a first follower arm engageable with a first cam of the camshaft and operable to selectively bias said pushrod;

a second follower arm engageable with a second cam of the camshaft and selectively latchable with respect to said first follower arm for unitary movement;

a third follower arm engageable with a third cam of the camshaft and selectively latchable with respect to said first follower arm for unitary movement;

wherein said first and second cam have respective first and second maximum valve lifts, said second maximum valve lift being greater in magnitude than said first maximum valve lift;

wherein said third cam has a third maximum valve lift of greater magnitude than said first and second maximum valve lifts;

wherein the poppet valve is opened to said third maximum valve lift when said third follower arm is latched to said first follower arm;

wherein the poppet valve is opened to said first maximum valve lift when said second follower arm is unlatched from said first follower arm; and wherein the poppet valve is opened to said second maximum valve lift when said second follower arm is latched to said first follower arm.

2. The multi-step valve actuation system of claim 1, further comprising a lash adjuster disposed between said first follower arm and said pushrod.

3. The multi-step valve actuation system of claim 2, wherein said lash adjuster includes a roller assembly in contact with said first follower arm.

4. The multi-step valve actuation system of claim 2, wherein said lash adjuster is selectively collapsible to maintain the poppet valve in a closed position irrespective of camshaft rotation.

5. The multi-step valve actuation system of claim 1, wherein at least one of said first and second follower arms rotatably supports a roller assembly engageable with a respective one of said first and second cams.

6. The multi-step valve actuation system of claim 1, wherein said third follower arm rotatably supports a roller assembly engageable with said third cam.

7. The multi-step valve actuation system of claim 1, wherein the internal combustion engine includes a cylinder head mounted with respect to the cylinder block and wherein said rocker arm is pivotably mounted with respect to the cylinder head and the poppet valve is at least partially contained within the cylinder head.

8. The multi-step valve actuation system of claim 1, further comprising a first spring member operable to bias said second follower arm toward said second cam.

9. The multi-step valve actuation system of claim 8, further comprising a second spring member operable to bias said third follower arm toward said third cam.

10. An internal combustion engine comprising:

a cylinder block;

a cylinder head mounted with respect to said cylinder block;

a selectively openable poppet valve at least partially disposed within said cylinder head;

a rocker arm pivotably mounted with respect to said cylinder head and operable to selectively open said poppet valve;

a camshaft having a plurality of cams and rotatably supported within said cylinder block;

a first follower arm engageable with a first cam of said plurality of cams;

a second follower arm engageable with a second cam of said plurality of cams and selectively latchable with respect to said first follower arm;

a third follower arm engageable with a third cam of said plurality of cams and selectively latchable with respect to one of said first and second follower arms;

wherein said first and second cam have respective first and second maximum valve lifts, said second maximum valve lift being greater in magnitude than said first maximum valve lift;

wherein said third cam has a third maximum valve lift of greater magnitude than said first and second maximum valve lifts;

wherein said selectively openable poppet valve is opened to said third maximum valve lift when said third follower arm is latched to said one of said first and second follower arms;

wherein said selectively openable poppet valve is opened to said first maximum valve lift when said second follower arm is unlatched from said first follower arm; and wherein said selectively openable poppet valve is opened to said second maximum valve lift when said second follower arm is latched to said first follower arm.

11. The internal combustion engine of claim 10, further comprising:

a lash adjuster disposed between said first follower arm and said pushrod; and wherein said lash adjuster is one of a selectively collapsible and non-collapsible type.

12. The internal combustion engine of claim 11, wherein said lash adjuster includes a roller assembly in contact with said first follower arm.

13. The internal combustion engine of claim 10, wherein at least one of said first and second follower arms rotatably supports a roller assembly engageable with a respective one of said first and second cams.

14. The internal combustion engine of claim 10, wherein said third follower arm rotatably supports a roller assembly engageable with said third cam.

15. A multi-step valve actuation system to selectively open a poppet valve of an internal combustion engine having a camshaft rotatably supported by a cylinder block, the multi-step valve actuation system comprising:

a rocker arm operable to selectively open the poppet valve;

a pushrod operable to bias said rocker arm;

a first follower arm engageable with a first cam of the camshaft and operable to selectively bias said pushrod;

a lash adjuster disposed between said first follower arm and said pushrod;

a second follower arm engageable with a second cam of the camshaft and selectively latchable with respect to said first follower arm;

a third follower arm engageable with a third cam of the camshaft and selectively latchable with respect to said first follower arm;

wherein said first, second, and third cams have respective first, second, and third maximum valve lifts;

wherein said third maximum valve lift is greater in magnitude than said second maximum valve lift and said second maximum valve lift is greater in magnitude than said first maximum valve lift;

wherein the poppet valve is opened to said first maximum valve lift when said second follower arm is unlatched from said first follower arm;

wherein the poppet valve is opened to said second maximum valve lift when said second follower arm is latched to said first follower arm; and wherein the poppet valve is opened to said third maximum valve lift when said third follower arm is latched to said first follower arm.

16. The multi-step valve actuation system of claim 15, wherein said lash adjuster is selectively collapsible.

17. The multi-step valve actuation system of claim 15, wherein at least one of said first, second, and third follower arms include a roller assembly engageable with a respective one of said first, second, and third cams.

18. The multi-step valve actuation system of claim 15, further comprising first and second spring members operable to bias a respective one of said second and third follower arms toward said respective second and third cams.

* * * * *